US009010422B2

(12) United States Patent
Donovan

(10) Patent No.: US 9,010,422 B2
(45) **Date of Patent: *Apr. 21, 2015**

(54) REMOTE ACTIVATED DEFLECTOR

(71) Applicant: Halliburton Energy Services, Inc., Houston, TX (US)

(72) Inventor: Stacey B. Donovan, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/911,076

(22) Filed: Jun. 6, 2013

(65) Prior Publication Data

US 2014/0034298 A1 Feb. 6, 2014

Related U.S. Application Data

(63) Continuation of application No. PCT/US2012/049227, filed on Aug. 1, 2012.

(51) Int. Cl.
*E21B 41/00* (2006.01)
*E21B 47/02* (2006.01)
*E21B 23/12* (2006.01)

(52) U.S. Cl.
CPC ..... *E21B 41/0035* (2013.01); *E21B 47/02* (2013.01); *E21B 23/002* (2013.01)

(58) Field of Classification Search
CPC ..... E21B 41/0035; E21B 23/002
USPC ..... 166/66, 250.01, 255.2
See application file for complete search history.

(56) References Cited

U.S. PATENT DOCUMENTS

| | | | | |
|---|---|---|---|---|
| 3,472,317 | A | 10/1969 | Fowler | |
| 3,545,474 | A * | 12/1970 | Brown | 137/876 |
| 3,599,711 | A | 8/1971 | Fowler | |
| 3,773,062 | A | 11/1973 | McIver | |
| 3,881,516 | A | 5/1975 | Childers et al. | |
| 5,411,082 | A * | 5/1995 | Kennedy | 166/181 |
| 7,373,984 | B2 * | 5/2008 | Pratt et al. | 166/313 |
| 7,503,398 | B2 * | 3/2009 | LoGiudice et al. | 166/386 |
| 8,789,590 | B2 | 7/2014 | Donovan | |
| 2002/0121375 | A1 | 9/2002 | Ohmer et al. | |
| 2002/0158120 | A1 | 10/2002 | Zierolf | |
| 2005/0115708 | A1 | 6/2005 | Jabusch | |

(Continued)

FOREIGN PATENT DOCUMENTS

WO 2014021889 A1 2/2014

OTHER PUBLICATIONS

Donovan, Stacey B., International Application entitled, "Remote Activated Deflector", filed on Aug. 1, 2012, PCT Serial No. PCT/US12/49227 2012-IP-055472 U1 PCT (4391-06200).

(Continued)

*Primary Examiner* — Giovanna Wright
*Assistant Examiner* — Richard Alker

(57) ABSTRACT

A wellbore y-block junction comprises a first bore channel, a second bore channel, a deflector selectable to a neutral position, to a first bore channel selected position, and to a second bore channel selected position, a radio receiver, and a controller, wherein the controller is configured to command the deflector position to one of the neutral position, the first bore channel selected position, or the second bore channel selected position based on an input from the radio receiver.

15 Claims, 7 Drawing Sheets

(56) References Cited

U.S. PATENT DOCUMENTS

| | | | | |
|---|---|---|---|---|
| 2006/0042792 | A1 | 3/2006 | Connell | |
| 2008/0073515 | A1 | 3/2008 | Schoen | |
| 2008/0110643 | A1 | 5/2008 | Richard et al. | |
| 2009/0090853 | A1 | 4/2009 | Schoen et al. | |
| 2009/0107725 | A1 * | 4/2009 | Christy et al. | 175/50 |
| 2009/0229838 | A1 | 9/2009 | Richard et al. | |
| 2009/0294124 | A1 | 12/2009 | Patel | |
| 2011/0248566 | A1 | 10/2011 | Purkis | |
| 2014/0124198 | A1 | 5/2014 | Donovan | |

OTHER PUBLICATIONS

"In-Depth Systems, Inc. Announces License for Breakthrough Radio Frequency Identification (RFID) Technology", http://www2.prnewswire.com/cgi-bin/stories.pl?ACCT=104&Story=/www/story/07-02-, In-Depth Systems, Inc., accessed May 18, 2012.

Fraley, Karen, et al., "RFID Technology for Downhole Well Applications" www.iiitec.com, pp. 60-62, Exploration & Production—Oile & Gas Review 2007—OTC Edition,Touch Briefings 2007.

Snider, Phillip, et al., "Marathon, partners adapt RFID technology for downhole drilling, completion applications", pp. 40 and 42, Drilling Contractor, Mar./Apr. 2007.

Foreign Communication from a Related Counterpart Application, International Search Report and Written Opinion dated Feb. 28, 2013, International Application No. PCT/US12/49227, filed on Aug. 1, 2012.

Donovan, Stacey Blaine, U.S. Appl. No. 13/991,901 entitled, "Remote Activated Deflector", filed Jun. 6, 2013 2012-IP-055472 U1 US.

FAIPP Pre-Interview Communication dated Mar. 10, 2014, filed on Jun. 6, 2013, U.S. Appl. No. 13/991,901.

Notice of Allowance dated May 23, 2014, filed Jun. 6, 2013, U.S. Appl. No. 13/991,901.

FAIPP Office Action dated Apr. 22, 2014, filed Jun. 6, 2013, U.S. Appl. No. 13/991,901.

* cited by examiner

REMOTE ACTIVATED DEFLECTOR

CROSS-REFERENCE TO RELATED APPLICATIONS

This application is continuation under 35 U.S.C. 120 of and claims priority to International Application No. PCT/US12/49227, filed Aug. 1, 2012, entitled "REMOTE ACTIVATED DEFLECTOR," which is incorporated herein by reference in its entirety for all purposes.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

A variety of servicing operations may be performed on a wellbore after it has been initially drilled. A lateral junction may be set in the wellbore at the intersection of two lateral wellbores and/or at the intersection of a lateral wellbore with the main wellbore. A casing string may be set and cemented in the wellbore. A liner may be hung in the casing string. The casing string may be perforated by firing a perforation gun. A packer may be set and a formation proximate to the wellbore may be hydraulically fractured. A plug may be set in the wellbore. Typically it is undesirable for debris, fines, and other material to accumulate in the wellbore. Fines may comprise more or less granular particles that originate from the subterranean formations drilled through or perforated. The debris may comprise material broken off of drill bits, material cut off casing walls, pieces of perforating guns, and other materials. A wellbore may be cleaned out or swept to remove fines and/or debris that have entered the wellbore. Those skilled in the art may readily identify additional wellbore servicing operations. In many servicing operations, a downhole tool is conveyed into the main wellbore and possibly into one or more laterals drilled off of the main wellbore and/or drilled off of a lateral wellbore.

SUMMARY

In an embodiment, a wellbore y-block junction is disclosed. The y-block junction comprises a first bore channel, a second bore channel, a deflector selectable to a neutral position, to a first bore channel selected position, and to a second bore channel selected position, a radio receiver, and a controller, wherein the controller is configured to command the deflector position to one of the neutral position, the first bore channel selected position, or the second bore channel selected position based on an input from the radio receiver.

In an embodiment, a method of performing a wellbore service job is disclosed. The method comprises running in a tool string into a wellbore above a first y-block junction, wherein the wellbore comprises at least a first bore and a second bore, wherein the tool string carries a radio frequency identity (RFID) tag on an end of the tool string, reading the radio frequency identity tag by a first controller of the first y-block junction, and directing the tool string into the first bore based on reading the radio frequency identity tag.

In an embodiment, a method of performing a wellbore service job is disclosed. The method comprises running in a tool string into a wellbore above a first y-block junction, wherein the wellbore comprises at least a first bore and a second bore, wherein the tool string carries a first near field communication (NFC) transceiver on an end of the tool string, transmitting a command from the first near field communication transceiver to a second near field communication transceiver coupled to the first y-block junction, and directing the tool string into the first bore based on the command.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
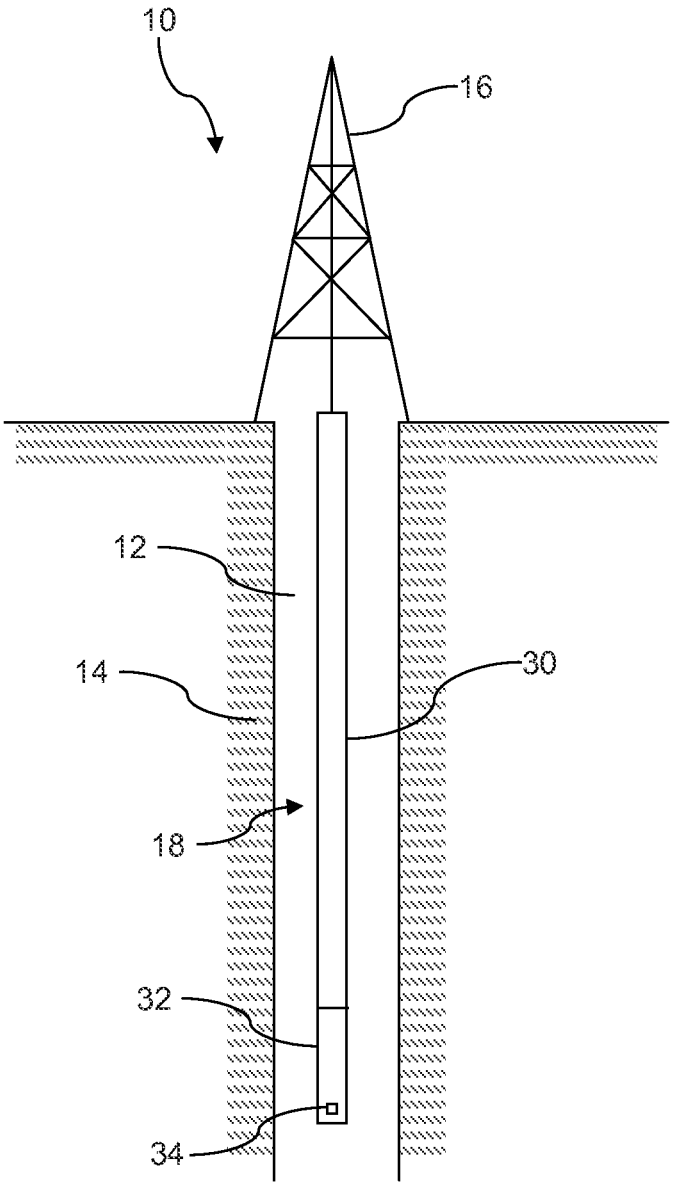
FIG. 1 illustrates a wellbore and a workstring therein according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation, such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

In an embodiment, a y-block junction having a selectable position deflector is described. The y-block junction promotes downhole access to two bores, for example to a first lateral bore and to a second lateral bore. The y-block junction incorporates a deflector that may be positioned to one of a neutral position, a first bore channel selected position, or a second bore channel selected position. When the deflector is positioned to the first bore channel selected position, a bottom hole assembly that is run into the y-block junction is directed by the position deflector into the first bore. When the deflector is positioned to the second bore channel selected position, a bottom hole assembly that is run into the y-block junction is directed by the position deflector into the second bore. In an embodiment, the y-block junction comprises a controller that commands the deflector to a position selected by logic executed by the controller.

The deflector may be actuated by an electric motor or solenoid coupled to and commanded by the controller. Alternatively, the deflector may be actuated by motive force derived from fluid flow, under the command of the controller. The deflector may be actively held in position in one of the neutral position, the first bore channel selected position, or the second bore channel selected position. Alternatively, the deflector may be displaced to one of the first bore channel selected position, the second bore channel selected position, or the neutral position and may then be mechanically maintained in that position, for example by a détente or by a mechanical locking mechanism. When the deflector is commanded to change position, the controller may command release of a mechanical locking mechanism.

A communication device may be coupled to the bottom hole assembly. The controller may receive identification information or control information from the communication device coupled to the bottom hole assembly, process the identification information with controller logic, and command the deflector position based on the processing of the identification information. In an embodiment, a radio frequency identity (RFID) tag is coupled to the bottom hole assembly that contains an identity. The controller may be preconfigured to command the deflector to a specific position when the subject RFID tag is detected proximate to the y-block junction, for example by a radio frequency identity scanner coupled to the controller. When a wellbore comprises multiple y-block junctions, the bottom hole assembly may comprise a plurality of RFID tags, one or more RFID tags associated with each y-block junction. Alternatively, a single RFID tag may encode a plurality of separate identities, each separate identity associated with a different y-block junction. In this way, an arbitrary sequence of deflector positions in each of the transited y-block junctions can be commanded as the bottom hole assembly is run into the wellbore.

Alternatively, the communication device may comprise a near field communication (NFC) radio transceiver. The NFC transceiver of the bottom hole assembly may engage in two-way communication with a NFC radio transceiver coupled to the y-block junction and to the controller. The NFC transceiver of the bottom hole assembly may send a message to the NFC radio transceiver coupled to the controller, where the message indicates which position to drive the deflector to. The y-block junction may incorporate sensors or limit switches that determine what position the deflector is in, and the controller may direct the NFC transceiver coupled to the controller to send a reply message to the NFC transceiver of the bottom hole assembly. The NFC transceiver of the bottom hole assembly may transmit the position information to a device located at the surface proximate the wellbore, for example to an electronic workstation or command station. The operators at the surface may decide to continue to run the bottom hole assembly into the wellbore or take some other action in response to the position information received from the NFC transceiver of the bottom hole assembly.

Some systems rely upon a diameter of the bottom hole assembly. For example, a larger diameter bottom hole assembly may be excluded from a first bore and allowed into a second bore, and a smaller diameter bottom hole assembly may be preferentially directed to the first bore. When the wellbore comprised three or more laterals, using different diameter tools to select the several different laterals may become impractical. The selectable deflector taught herein may overcome this limitation in some wellbore environments.

Turning now to FIG. 1, a wellbore servicing system 10 is described. The system 10 comprises a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The servicing rig 16 may be one of a drilling rig, a completion rig, a workover rig, a servicing rig, or other mast structure that supports a workstring 18 in the wellbore 12. In other embodiments a different structure may support the workstring 18, for example an injector head of a coiled tubing rigup. In an embodiment, the servicing rig 16 may comprise a derrick with a rig floor through which the workstring 18 extends downward from the servicing rig 16 into the wellbore 12. In some embodiments, such as in an off-shore location, the servicing rig 16 may be supported by piers extending downwards to a seabed. Alternatively, in some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude sea water and contain drilling fluid returns. It is understood that other mechanical mechanisms, not shown, may control the run-in and withdrawal of the workstring 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 18 may comprise a conveyance 30, a bottom hole assembly (BHA) 32, and other tools and/or subassemblies (not shown) located above the bottom hole assembly 32. A communication device 34 is coupled to the bottom hole assembly 32. In an embodiment, a plurality of communication devices 34 may be coupled to the bottom hole assembly 32. The conveyance 30 may comprise any of a string of jointed pipes, a slickline, a coiled tubing, a wireline, and other conveyances for the bottom hole assembly 32.

In an embodiment, the communication device 34 is a radio frequency identity (RFID) tag that transmits an indication of identity when queried by a RFID scanner. In an embodiment, a plurality of RFID tags may be coupled to the bottom hole assembly 32, for example at least one RFID tag for each of a plurality of y-block junctions that the bottom hole assembly 32 is desired to transit on its way into the wellbore and various lateral bores to perform a service job. Alternatively, a single RFID tag may encode a plurality of separate identities, a separate identity for each of the y-block junctions. In an embodiment, multiple RFID tags containing the same identification information may be coupled to the bottom hole assembly 32 to provide redundancy in case one of the RFID tags is knocked off the bottom hole assembly 32 on the trip into the wellbore 12.

Alternatively, in an embodiment, the communication device 34 is a near field communication (NFC) radio transceiver that engages in two-way radio communication with appropriately configured radios and engages in two-way wired communication with a communication device at the surface of the wellbore 12. For example, the communication device 34 may be coupled to the surface by a wire coupled to, contained within or inside, retained by, or twined around the work string 18. Alternatively, the communication device 34 may be coupled to the surface through two way communication using another telemetry system, for example using acoustic waves or mechanical pressure waves.

Figure 2A:
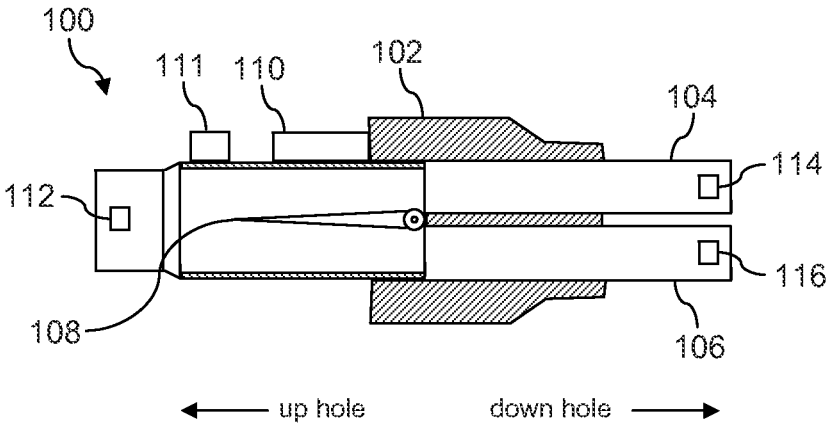
FIG. 2A, FIG. 2B, and FIG. 2C illustrate a y-block junction according to an embodiment of the disclosure.
Figure 2B:
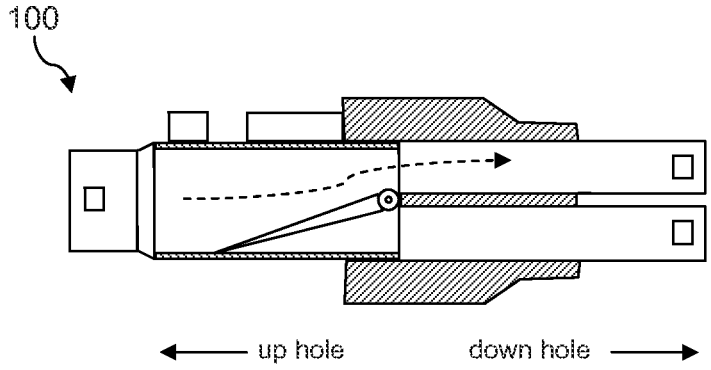
Figure 2C:
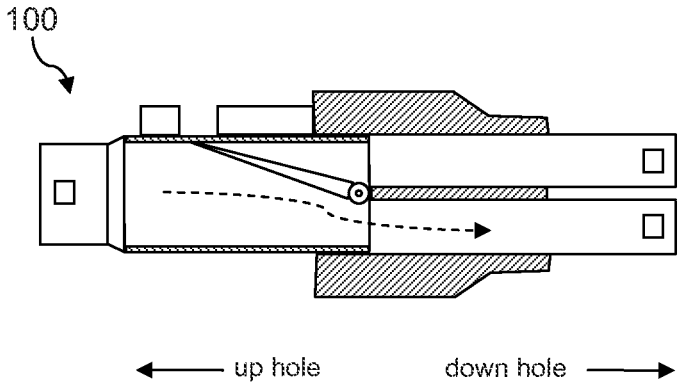

Turning now to FIG. 2A, FIG. 2B, and FIG. 2C, a y-block junction 100 is described. In an embodiment, the y-block junction 100 comprises a tool body 102, a first bore channel 104, a second bore channel 106, a deflector 108, a controller 110, a radio 111, and an antenna 112. In an embodiment, the y-block junction 100 may further comprise a second antenna 114 coupled to the first bore channel 104 and a third antenna 116 coupled to the second bore channel 106. It is understood that the illustration of the y-block junction 100 is not intended to represent the relative sizes of the components but to illustrate the function of the several components. In another embodiment, the lengths, the diameters, and the thicknesses of the components may be different. The y-block junction 100 is intended to be placed at the junction of two wellbores, for example the junction of a main wellbore with a lateral wellbore or the junction of a first lateral wellbore with a second lateral wellbore. When the y-block junction 100 is installed at the junction of two wellbores, the first bore channel 104 is stabbed or inserted into one of the wellbores and the second bore channel 106 is stabbed or inserted into the other of the two wellbores. The y-block junction 100 may be secured in position in the wellbore 12 by deploying slips against a casing wall, by expanding a portion of the y-block junction 100 to engage with a casing wall or liner hanger, or by another mechanism.

In FIG. 2A, the deflector 108 is shown in the neutral position; in FIG. 2B, the deflector 108 is shown in the first bore channel selected position; and in FIG. 2C, the deflector 108 is shown in the second bore channel selected position. The dotted arrow in FIG. 2B indicates that a bottom hole assembly running down hole at the y-block junction 100 would be deflected into the first bore channel 104 when the deflector 108 is in the first bore channel selected position. The dotted arrow in FIG. 2C indicates that a bottom hole assembly running down hole at the y-block junction 100 would be deflected into the second bore channel 106 when the deflector 108 is in the second bore channel selected position. In an embodiment, the deflector 108 may be provided with sealing edges so that when positioned as illustrated in FIG. 2B, the deflector 108 substantially blocks the flow of fluid up hole at the y-block junction 100 from the second bore channel 106 and when positioned as illustrated in FIG. 2C, the deflector 108 substantially blocks the flow of fluid up hole at the y-block junction 100 from the first bore channel 104.

The deflector 108 may be actuated to a position by an electric motor (not shown) that engages gears coupled to the deflector 108. Alternatively, the deflector 108 may be actuated to a position by an electric solenoid (not shown). The electrical power may be provided by a battery coupled to the y-block junction 100. Alternatively, the deflector 108 may be actuated to a position by a motor powered by fluid flow.

In an embodiment, the deflector 108 may be spring loaded to the neutral position illustrated in FIG. 2A. When the bottom hole assembly 32 is being run into the first bore channel 104, the deflector 108 may be actuated to the first bore channel selected position. After the bottom hole assembly 32 has entered the first bore channel 104, the actuation of the deflector 108 may discontinue, and the deflector 108 may be driven back to the neutral position by a spring. Alternatively, the deflector 108 may continue to be actuated to the first bore channel selected position. Alternatively, the deflector 108 may be actuated to the first bore channel selected position, a mechanical mechanism may latch the deflector 108 into position, the actuation may be discontinued, and the deflector 108 may remain in the selected position, maintained in that position by the mechanical mechanism. When the deflector 108 is desired to be actuated to the neutral position, the mechanical mechanism may be disengaged, and the deflector 108 may be actuated to the neutral position or returned to the neutral position by spring loading. The alternative behaviors for actuating the deflector 108 to the first bore channel selected position and back to the neutral position may be substantially similar when actuating the deflector 108 to the second bore channel selected position, for example substituting the second channel bore and second channel bore selected position in the above description.

The radio 111 is coupled to the controller 110. In an embodiment, the radio 111 may be a radio receiver. In an embodiment, the radio 111 may be an RFID tag scanner and may only emit radio energy sufficient to energize an RFID tag coupled to the bottom hole assembly 32. Alternatively, the radio 111 may be a radio transceiver capable of two-way radio communication, for example a NFC radio transceiver. One skilled in the art appreciates that a radio transceiver comprises both a radio receiver and a radio transmitter. The controller 110 may execute logic such as software instructions, firmware instructions, or other type of logic instructions. The controller 110 may be implemented as a computer. Computers are described further hereinafter.

In an embodiment, the communication device 34 coupled to the bottom hole assembly 32 comprises one or more radio frequency identity (RFID) tags and the radio 111 is a radio receiver, such as an RFID scanner. When the bottom hole assembly 32 is run in and approaches the y-block junction 100 from up hole, the antenna 112 and/or the radio 111 scans the RFID tag of the communication device 34, learns the identity of the RFID tag, and provides the identity to the controller 110. In an embodiment, the radio 111 may decode the identity itself and provide the identity to the controller 110. In another embodiment, however, the radio 111 provides a signal to the controller 110, and the controller decodes the identity based on the signal received from the radio 111. In either case, the radio 111 may be said to provide an input to the controller 110 that identifies the RFID tag.

The controller 110 may be configured to command the position of the deflector 108 based on the identity of the RFID tag. For example, an RFID tag input having a '5' identity may cause logic that executes in the controller 110 to command the deflector 108 to the first bore channel selected position. By appropriately configuring the controller 110 before installing the y-block junction 100 in the wellbore 12 and by coupling an RFID tag having the appropriate identity to the bottom hole assembly 32, the deflection of the bottom hole assembly 32 into either the first bore channel 104 or the second bore channel 106 can be controlled. While the identity is described in terms of exemplary values (e.g., a '5' identity), it should be understood that the identity may comprise any value, code, combination of values, and/or any other type of signal used to identify one or more devices. Additional exemplary values are provided herein for purposes of description and discussion only, and the values are not intended to limit the types of identities/values that can be used with the systems and methods described herein.

When multiple y-block junctions 100 are present in a wellbore 12, a plurality of RFID tags may be coupled to the bottom hole assembly 32. In this case, the antenna 112 may provide multiple identities to the controller 110, each identity associated with one of the RFID tags. Alternatively, a single RFID tag may encode multiple RFID tag identities. Either the radio 111 or the controller 110 may parse and separate the several multiple RFID tag identities encoded in the single RFID tag. When multiple RFID tag identities are encoded in a single RFID tag, the RFID tag identities may be distinguished or delimited in some way.

Figure 6:
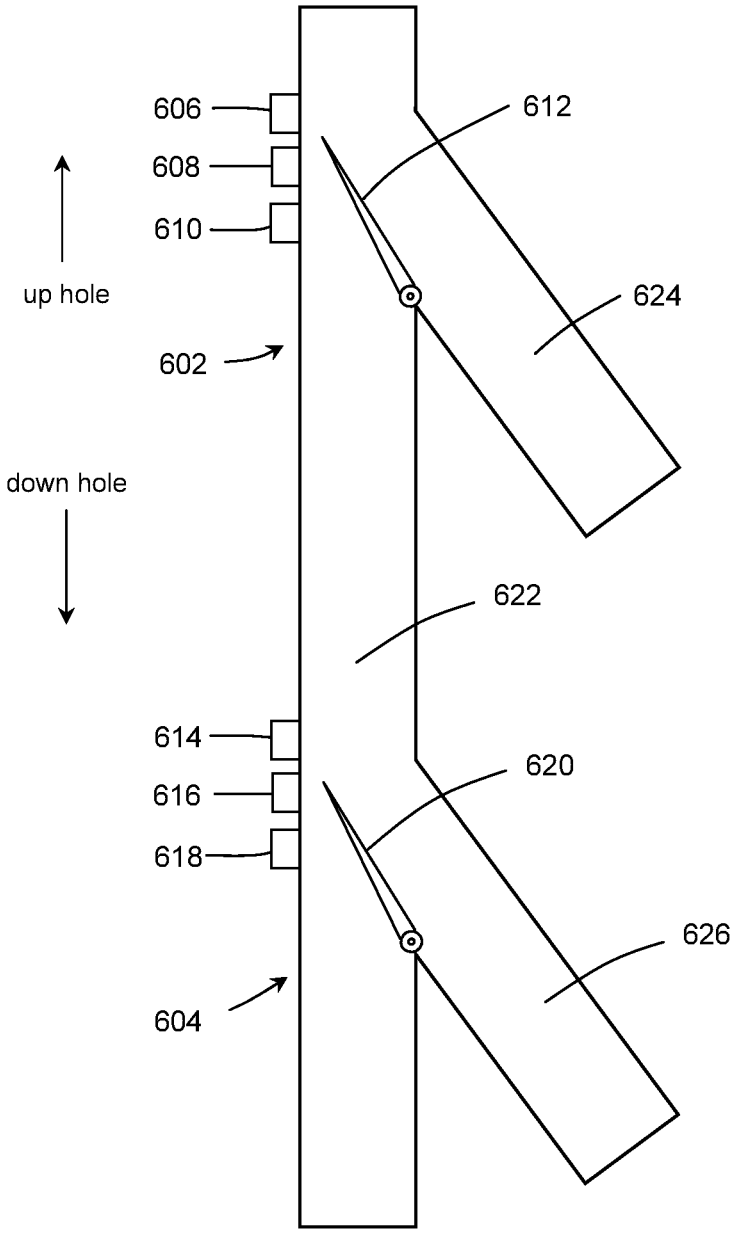
FIG. 6 illustrates a plurality of y-block junctions according to an embodiment of the disclosure.

The controller 110 may ignore RFID tag identities that it is not configured to respond to and only respond to those RFID tags it is configured to respond to. For example, and referring now to FIG. 6, a first y-block junction 602 is located up hole from a second y-block junction 604. The first y-block junction 602 is located at the junction of bore 622 and bore 624, provides access into bore 622 when deflector 612 of the first y-block junction 602 is selected to the first bore channel selected position, and provides access into bore 624 when the deflector 612 of the first y-block junction 602 is selected to the second bore channel selected position. The second y-block junction 604 is located at the junction of bore 622 and a-G bore 626, provides access into bore 622 when the deflector 620 of the second y-block junction 604 is selected to the first bore channel selected position, and provides access to bore 626 when the deflector 620 of the second y-block junction 604 is selected to the second bore channel selected position. As shown in FIG. 6, each junction 602 and 604 includes a controller 606 and 614 and a radio 608 and 616, respectively. As discussed elsewhere, each junction 602 and 604 may include a deflector position sensor 610 and 618, respectively.

In an embodiment, a first RFID tag having a '5' identity and a second RFID tag having an '8' identity may be coupled to the bottom hole assembly. Alternatively, a single RFID tag is coupled to the bottom hole assembly that is encoded with both a '5' identity and an '8' identity. The controller 606 of the first y-block junction 602 may be configured to select the deflector 612 to the first bore channel selected position when a '5' identity is input by the antenna and to select the deflector 612 to the second bore channel selected position when a '6' identity is input by the antenna. The controller 614 of the second y-block junction 604 may be configured to select the deflector 620 to the first bore channel selected position when a '7' identity is input by the antenna and to select the deflector 620 to the second bore channel selected position when an '8' identity is input by the antenna. As the bottom hole assembly approaches the first y-block junction 602 from up hole, the antenna sends the two RFID identities '5' and '8' to the controller 606 of the first y-block junction 602. The controller 606 is not configured to respond to '8'. The controller 606 responds to the '5' RFID identity and commands the deflector 612 of the first y-block junction 602 to the first bore channel selected position, directing the bottom hole assembly into bore 622.

As the bottom hole assembly approaches the second y-block junction 604 from up hole (down hole now of the first y-block junction 602), the antenna sends the two RFID identities '5' and '8' to the controller 614 of the second y-block junction 604. The controller 614 is not configured to respond to the '5'. The controller 614 responds to the '8' RFID identity and commands the deflector 620 of the second y-block junction 604 to the second bore channel selected position, directing the bottom hole assembly into bore 626. It will be readily appreciated that any path through a series of lateral wellbores having y-block junctions installed at the subject junctions may be selectively navigated by coupling the appropriate RFID tags to the bottom hole assembly.

In an embodiment, redundant RFID tags may be coupled to the bottom hole assembly 32. In this way, if one of the redundant RFID tags is decoupled from the bottom hole assembly 32, the controller 110 may still read the appropriate RFID identity as the bottom hole assembly 32 approaches the y-block junction 100.

In another embodiment, the communication device 34 coupled to the bottom hole assembly 32 comprises a near field communication (NFC) radio transceiver and the radio 111 comprises a near field communication radio transceiver. As the bottom hole assembly 32 and the communication device 34 approach the antenna 112, the controller 110 and the communication device 34 establish a communication link via the radio 111. A variety of messages may be exchanged between the communication device 34 and the controller 110. The communication device 34 may send a message to the controller 110 commanding the position of the deflector 108 to one of the first bore channel selected position or the second bore channel selected position. The communication device 34 may query what the current position of the deflector 108 is, and the controller 110 may transmit a message indicating the current position of the deflector 108.

The communication device 34 may be communicatively coupled to a workstation at the surface of the wellbore 12. An operator at the surface may use the workstation to send a message down hole to the communication device 34 to command the controller 110 to set the deflector 108 to a preferred position. The controller 110 may transmit a message to the communication device 34 and there through to the workstation at the surface that identifies the y-block junction 100. This self-identification capability may be useful in corroborating assumptions of operators at the surface and provide a capability of detecting and correcting bore routing errors.

In an embodiment, the controller 110 may determine that the communication device 34 has passed through the first bore channel 104 by establishing a communication link with the communication device 34 via the second antenna 114. Likewise, the controller 110 may determine that the communication device 34 has passed through the second bore channel 106 by establishing a communication link with the communication device 34 via the third antenna 116. The controller 110 may infer from the established communication link between the antenna 114, 116 and the communication device 34 which bore the bottom hole assembly 32 has entered and transmit a corroborating message via the communication device 34 to the surface indicating which bore has been entered.

Figure 3A:
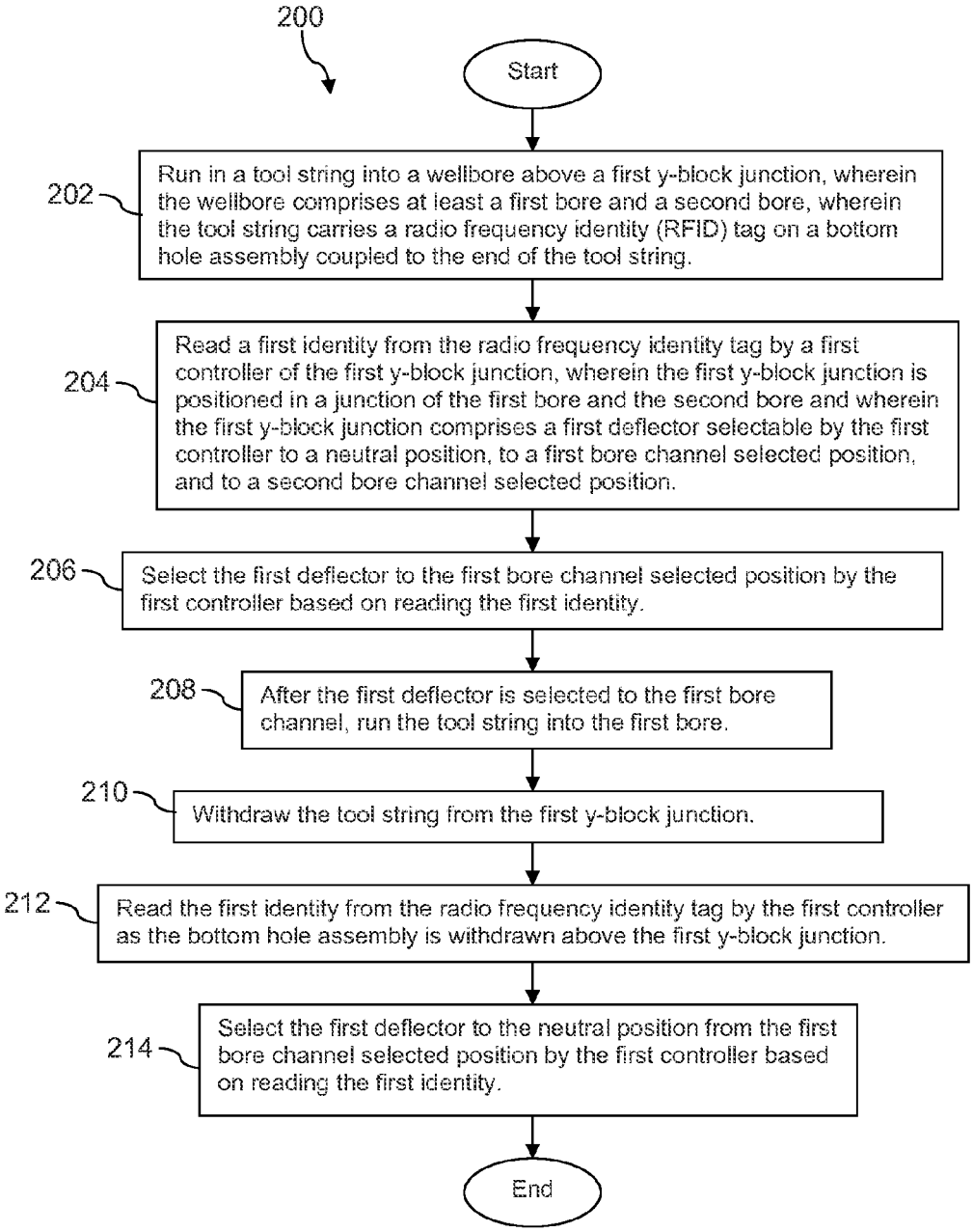
FIG. 3A is a flow chart of a method according to an embodiment of the disclosure.

Turning now to FIG. 3A, a method 200 is described. In an embodiment, the method comprises running in a tool string into a wellbore above a first y-block junction, wherein the wellbore comprises at least a first bore and a second bore, wherein the tool string carries a radio frequency identity (RFID) tag on an end of the tool string, reading an identity from the radio frequency identity tag by a first controller of the first y-block junction, and directing the tool string into the first bore based on reading the identity.

At block 202, the tool string 18 is run into the wellbore 12 above a first y-block junction 100, wherein the wellbore 12 comprises at least a first bore and a second bore, wherein the tool string 18 carries at least one RFID tag on the bottom hole assembly 32 coupled to the end of the tool string 18. At block 204, a first identity is read from the at least one RFID tag by a first controller 110 of the first y-block junction 100, wherein the first y-block junction 100 is positioned in a junction of the first bore and the second bore, and wherein the first y-block junction 100 comprises a first deflector 108 selectable by the first controller 110 to a neutral position, to a first bore channel selected position, and to a second bore channel selected position. In an embodiment, a plurality of identities may be encoded in a single RFID tag, for example a first identity and a second identity. Alternatively, in an embodiment, a single identity may be encoded in each of a plurality of RFID tags, for example the first identity encoded in a first RFID tag and a second identity encoded in a second RFID tag. Alternatively, a single RFID tag containing a single identity may be coupled to the bottom hole assembly 32, for example the first identity may be encoded in a single RFID tag coupled to the bottom hole assembly 32. It is understood that in an embodiment, redundant and/or duplicate RFID tags may be coupled to the bottom hole assembly 32. It is also understood that the controller 110 may recognize duplicate identities and respond appropriately, for example responding to the first identity only once as the bottom hole assembly 32 is run in. The controller 110 may maintain a timer that may be used to distinguish between reading the first identity from redundant RFID tags from reading the first identity a second time when the bottom hole assembly 32 is brought out of the wellbore.

At block 206, the first deflector 108 is selected to the first bore channel selected position by the first controller 110 based on reading the first identity. At block 208, after the first deflector 108 is selected to the first bore channel selected position, run the tool string 18 into the first bore. For example, run the bottom hole assembly 32 through the y-block junction 100, through the first bore channel 104, out of the first y-block junction 100, and on into the first bore.

At block 210, the tool string 18 may be withdrawn or removed from the first y-block junction 100. At block 212, read the first identity by the first controller 110 as the bottom hole assembly 32 is withdrawn above the first y-block junction 100. At block 214, select the first deflector to the neutral position from the first bore channel selected position by the first controller based on reading the first identity. Method 200 may be employed while conducting a wellbore service job. In an embodiment, blocks 212 and 214 may not be performed, and the deflector 108 may be spring loaded to the neutral position. After the bottom hole assembly 32 has passed downhole from the y-block junction 100, the deflector 108 may be released to the neutral position.

Figure 3B:
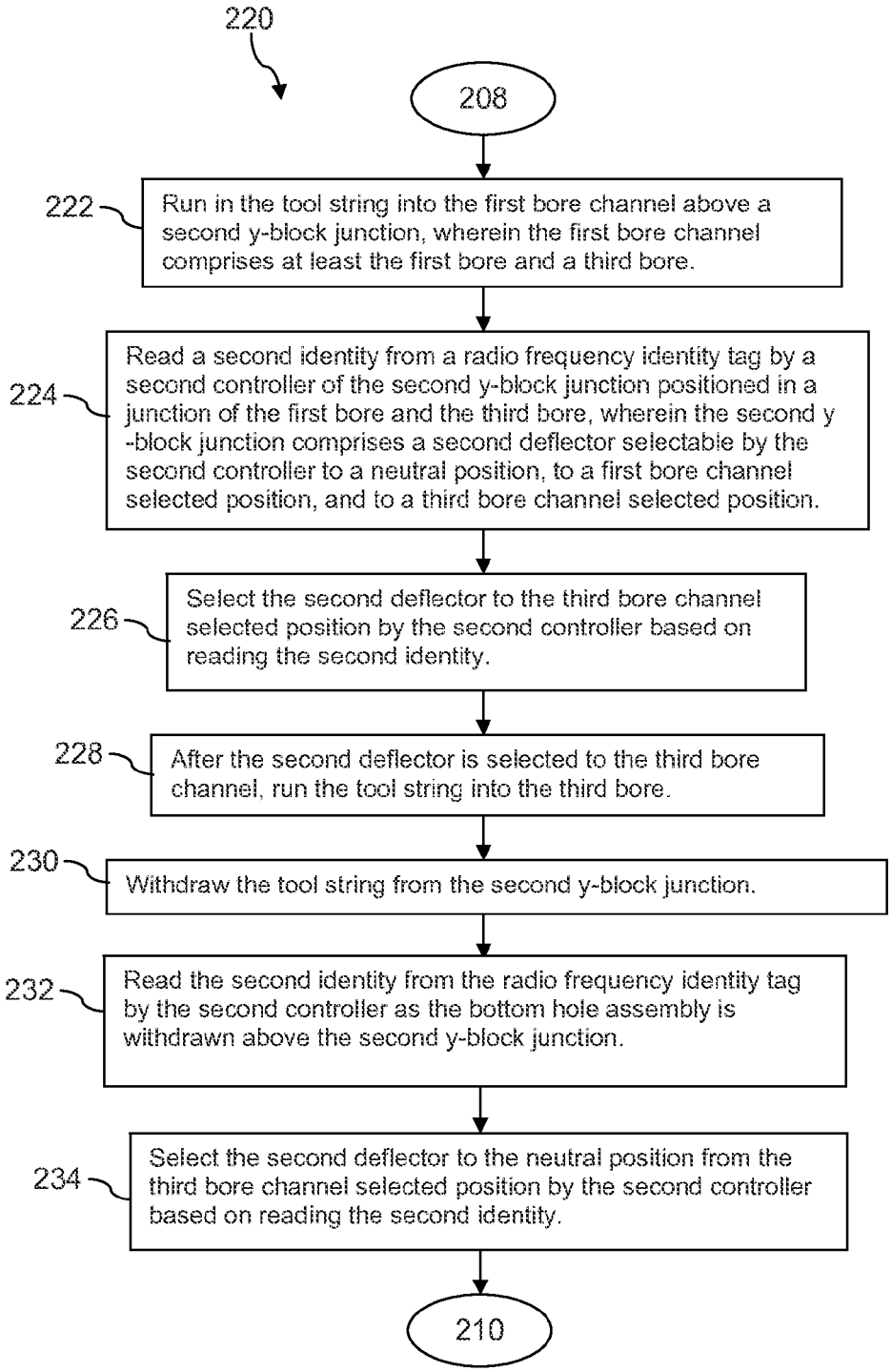
FIG. 3B is a flow chart of another method according to an embodiment of the disclosure.

Turning now to FIG. 3B, a method 220 is described. Method 220 is compatible with being performed between block 208 and block 210 of the method 200 described above with reference to FIG. 3A. In an embodiment, a second RFID tag associated with a second y-block junction 100 is coupled to the bottom hole assembly 32. Alternatively, the RFID tag encodes at least two separate RFID identities, the first RFID identity associated with the first y-block junction 100 and a second RFID identity associated with the second y-block junction 100. The second y-block junction 100 may be located down hole of the first y-block junction 100. At block 222, the tool string 18 is run into the first bore channel above the second y-block junction 100, wherein the first bore channel comprises at least the first bore and a third bore. At block 224, a second identity is read from the at least one RFID tag by a second controller 110 of the second y-block junction 100 positioned in a junction of the first bore and the third bore, wherein the second y-block junction 100 comprises a second deflector 108 selectable by the second controller 110 to a neutral position, to a first bore channel selected position, and to a third bore channel selected position.

At block 226, the second deflector 108 is selected to the third bore channel selected position by the second controller 110 based on reading the second identity. In an embodiment, a plurality of RFID tags may be coupled to the bottom hole assembly 32 and/or an RFID tag may encode a plurality of separate identities or RFID identities may be coupled to the bottom hole assembly 32. In this case, the controller 110 of the first y-block junction 100 may select the position of the deflector 108 of the first y-block junction 100 in block 208 above based on reading the first identity, and the second controller 110 of the second y-block junction 100 may select the position of the deflector 108 of the second y-block junction 100 based on reading the second identity.

At block 228, after the second deflector 108 of the second y-block junction 100 is selected to the third bore channel, the tool string 18 is run into the third bore. For example, run the bottom hole assembly 32 through the second y-block junction 100, through the second bore channel 106 of the second y-block junction 100, out of the second y-block junction 100, and on into the third bore. In this description, the second bore channel 106 of the second y-block junction 100 is stabbed into the third bore and the first bore channel 104 of the second y-block junction 100 is stabbed into the first bore.

At block 230, the tool string 18 is withdrawn from the second y-block junction 100. At block 232, read the second identity from the at least one RFID tag by the second controller 110 of the second y-block junction 100 as the bottom hole assembly 32 is withdrawn above the second y-block junction 100. At block 234, select the second deflector 108 to the neutral position from the third bore channel selected position by the second controller 110 of the second y-block junction 100 based on reading the second identity. In an embodiment, the processing of blocks 232 and 234 may not be performed.

Figure 4:
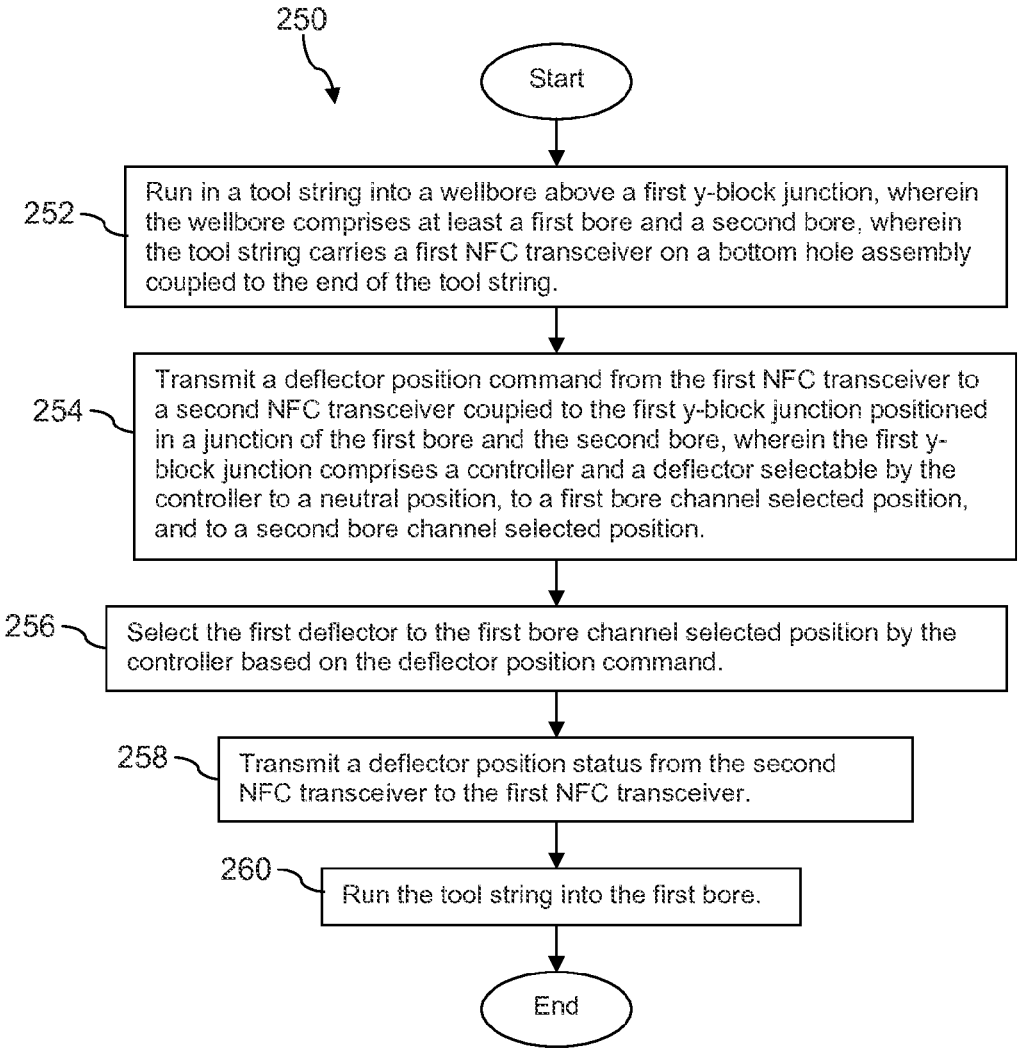
FIG. 4 is a flow chart of a method according to an embodiment of the disclosure.

Turning now to FIG. 4, a method 250 is described. In an embodiment, the method comprises running in a tool string into a wellbore above a first y-block junction, wherein the wellbore comprises at least a first bore and a second bore, wherein the tool string carries a first near field communication (NFC) transceiver on an end of the tool string, transmitting a command from the first near field communication transceiver to a second near field communication transceiver coupled to the first y-block junction, and directing the tool string into the first bore based on the command.

Method 250 may be performed while conducting a wellbore service job. At block 252, the tool string 18 is run into the wellbore 12 above a first y-block junction 100, wherein the wellbore 12 comprises at least a first bore and a second bore, wherein the tool string 18 carries a first NFC transceiver on a bottom hole assembly 32 coupled to the end of the tool string 18, for example the communication device 34 in an embodiment may be a NFC radio transceiver. At block 254, a deflector position command is transmitted from the first NFC transceiver to a second NFC transceiver (in an embodiment, the radio 111) coupled to the first y-block junction 100 positioned in a junction of the first bore and the second bore, wherein the first y-block junction 100 comprises a controller 110 and a deflector 108 selectable by the controller 110 to a neutral position, to a first bore channel selected position, and to a second bore channel selected position.

At block 256, the first deflector 108 is selected to the first bore channel selected position by the controller 110 based on the deflector position command received by the second NFC transceiver from the first NFC transceiver. At block 258, a deflector position status is transmitted from the second NFC transceiver to the first NFC transceiver. For example, after the first deflector 108 has been actuated into the commanded position, a micro switch or other sensor indicates the position or state of the first deflector 108, the controller 110 receives the indication, and transmits the position status via the second NFC transceiver to the first NFC transceiver. At block 260, the tool string 18 is run into the first bore, for example the bottom hole assembly 32 is run past the y-block junction 100 and on into the first bore.

Figure 5:
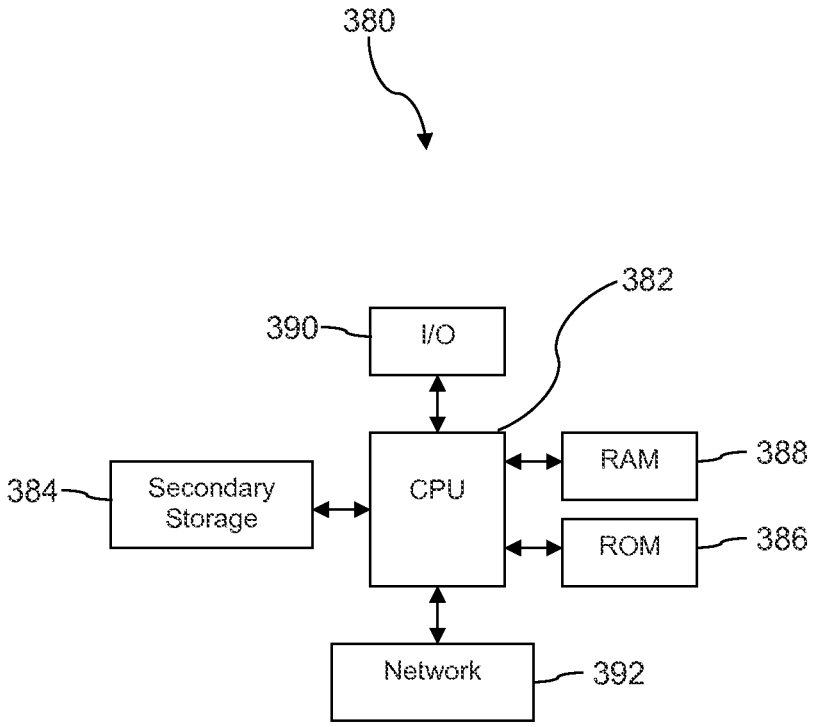
FIG. 5 is an illustration of a computer according to an embodiment of the disclosure.

FIG. 5 illustrates a computer system 380 suitable for implementing one or more aspects of an embodiment disclosed herein. For example, the controller 110 described above with reference to FIG. 2A, FIG. 2B, and FIG. 2C may be implemented in a form substantially similar to the computer system 380. The NFC radio transceiver coupled to the bottom hole assembly 32 and the communication device at the surface of the wellbore 12 described above may be implemented in a form substantially similar to the computer system 380. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, flash drives, optical disk (these various disk based systems may all be considered secondary storage 384), ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, flash drives, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of performing a wellbore service job, comprising:

running a tool string into a wellbore above a first junction in the wellbore, wherein the wellbore comprises at least a first bore and a second bore, wherein the tool string comprises a communication device, wherein the first junction is positioned in a junction of the first bore and the second bore, wherein the first junction comprises a first deflector selectable by a first controller to a plurality of positions comprising a first bore channel selected position, and a second bore channel selected position, the first deflector capable of sealingly engaging at least one of the first bore or the second bore;

receiving, by the first controller located at the first junction, a first signal from the communication device; and directing the tool string into the first bore based on reading the first signal received by the first controller.

2. The method of claim 1, wherein the communication device comprises a radio frequency identity (RFID) tag, and wherein the first signal comprises an identity communicated from the RFID tag.

3. The method of claim 2, wherein the first controller comprises a radio frequency identity (RFID) tag scanner.

4. The method of claim 3, wherein receiving the first signal comprises:

scanning the RFID tag with the RFID tag scanner; and receiving the first signal from the RFID tag scanner.

5. The method of claim 1, further comprising:

running the tool string into the wellbore above a second junction, wherein the wellbore further comprises at least a third bore;

receiving, by a second controller located at the second junction, a second signal from the communication device;

directing the tool string into the third bore based on reading the second signal.

6. The method of claim 5, wherein the communication device comprises a plurality of radio frequency identity (RFID) tags.

7. The method of claim 6, wherein the first signal comprises a first identity from a first RFID tag of the plurality of RFID tags, and wherein the second signal comprises a second identity from a second RFID tag of the plurality of RFID tags.

8. The method of claim 5, wherein the communication device comprises a radio frequency identity (RFID) tag, and wherein the first signal and the second signal comprises a single identity communicated from the RFID tag.

9. The method of claim 1, wherein the method further comprises:

selecting the first deflector to the first bore channel selected position by the first controller based on reading the first signal; and running the tool string into the first bore.

10. The method of claim 9, further comprising:

running the tool string through the first bore channel to a second junction, wherein the wellbore further comprises a third bore, wherein the second junction comprises a second deflector selectable by a second controller to a plurality of positions comprising a first bore channel selected position, and a third bore channel selected position;

receiving, by the second controller located at the second junction, a second signal from the communication device; and selecting the second deflector to the third bore channel selected position by the second controller based on reading the second signal.

11. The method of claim 10, wherein the first signal and the second signal are the same signal.

12. The method of claim 1, wherein the communication device comprises a first near field communication (NFC) transceiver on an end of the tool string, and wherein receiving the first signal comprises receiving, by a second near field communication transceiver coupled to the first controller, a command transmitted by the first NFC transceiver.

13. The method of claim 12, the wellbore junction further comprising a deflector position sensor, wherein the controller is further configured to command the near field communication radio transceiver to transmit a message containing an indication of the deflector position based in an input from the deflector position sensor.

14. The method of claim 1, wherein the first junction comprises the first deflector selectable by the controller to a plurality of positions comprising a first bore channel selected position and a second bore channel selected position, wherein the method further comprises actuating the first deflector to the first bore channel selected position using electrical energy.

15. The method of claim 1, wherein the first junction comprises the first deflector selectable by the controller to a plurality of positions comprising a first bore channel selected position and a second bore channel selected position, wherein the method further comprises actuating the first deflector to the first bore channel selected position using fluid flow.

* * * * *